United States Patent [19]

Day, Jr.

[11] 4,226,061

[45] Oct. 7, 1980

[54] REINFORCED MASONRY CONSTRUCTION

[76] Inventor: Paul T. Day, Jr., Apt. 14, 2909 Fallstaff Rd., Baltimore, Md. 21209

[21] Appl. No.: 916,126

[22] Filed: Jun. 16, 1978

[51] Int. Cl.[2] ..... E04H 17/00

[52] U.S. Cl. ..... 52/122; 52/672; 52/426; 52/380; 52/586; 52/713; 52/378; 52/127

[58] Field of Search ..... 52/426, 254, 255, 256, 52/258, 284, 712–715, 585, 586, 672, 645, 648, 612, 344, 227–229, 326, 378, 380, 613, 122, 127; 140/105, 107, 109; 245/10

[56] References Cited

U.S. PATENT DOCUMENTS

| | | | |
|---|---|---|---|
| 963,778 | 7/1910 | Kosack | 52/713 |
| 1,713,809 | 5/1929 | Allee | 140/109 |
| 1,746,440 | 2/1930 | Pawling | 52/326 |
| 2,271,900 | 2/1942 | Mowbray | 245/10 |
| 2,627,176 | 2/1953 | Levy | 52/228 |
| 3,176,433 | 4/1965 | Davies et al. | 52/585 |
| 3,478,482 | 11/1969 | Weir | 52/122 |
| 3,559,355 | 2/1971 | Day | 52/672 |
| 3,844,083 | 10/1974 | Farley | 52/672 |

FOREIGN PATENT DOCUMENTS

| | | | |
|---|---|---|---|
| 481597 | 3/1948 | Canada | 52/612 |
| 779582 | 7/1957 | United Kingdom | 52/344 |

*Primary Examiner*—James L. Ridgill, Jr.

*Attorney, Agent, or Firm*—Shlesinger, Arkwright, Garvey & Dinsmore

[57] ABSTRACT

Reinforced masonry construction including walls or slabs comprising elongated panels having permanent wall or slab forms (or skins) which are spaced a predetermined distance apart by unique ties which also serve as a web member or a component thereof resulting between reinforcing bars and/or structural shapes acting as the chords of a truss. The panels are preferably precast from high strength structural grade cellular concrete reinforced with a novel truss. The longitudinal edges of adjacent panels are in contiguous engagement, opposed panels being connected by a tie having portions which interfit the contiguous panels for positioning same. The ties are arranged in vertical or horizontal alignment and reinforcing rods, in unitary or multi-part arrangement, extend through the ties from one end to the other transversely of the wall or slab to provide or supplement a structural section. Low density cellular concrete may then be placed in the void between the wall forms or, in the case of a slab, poured to approximately the top of the truss chord and engaged with the wall ties and reinforcing rods or multi-part trusses to form a composite structure. Both faces of the permanent wall forms or the bottom face of the permanent slab form may be prefinished and the structures either prefabricated for erection at a plant or on the site or erected in situ.

34 Claims, 23 Drawing Figures

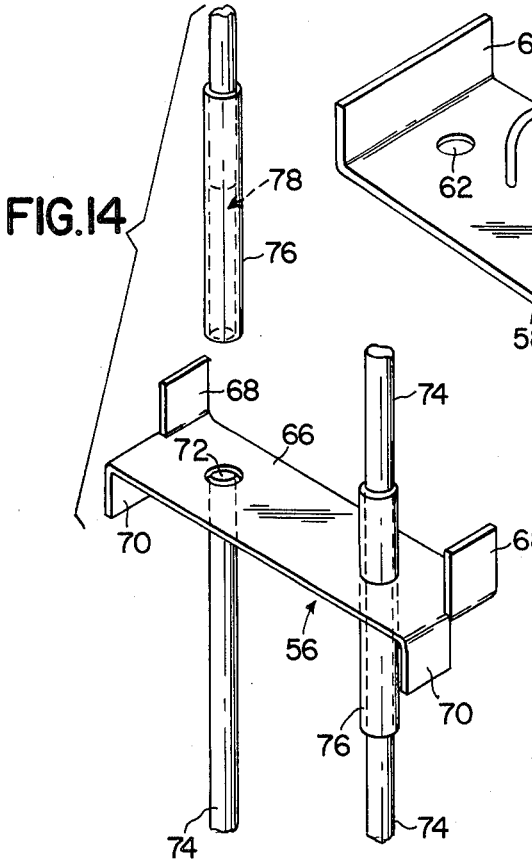
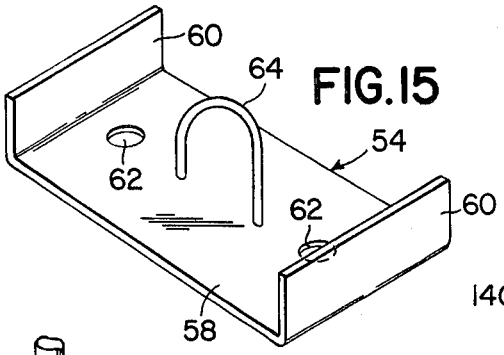
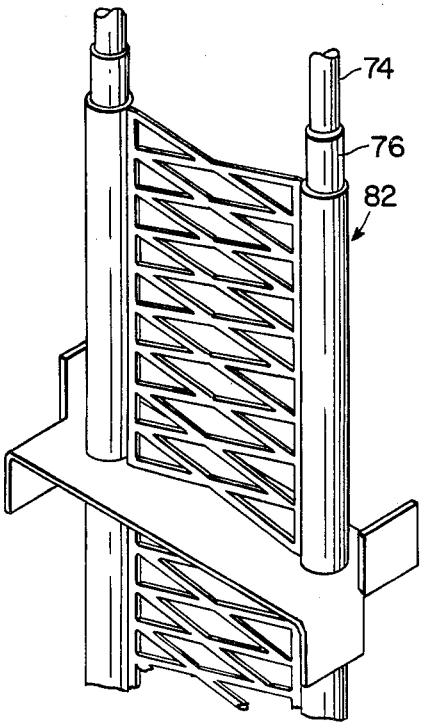
FIG.16
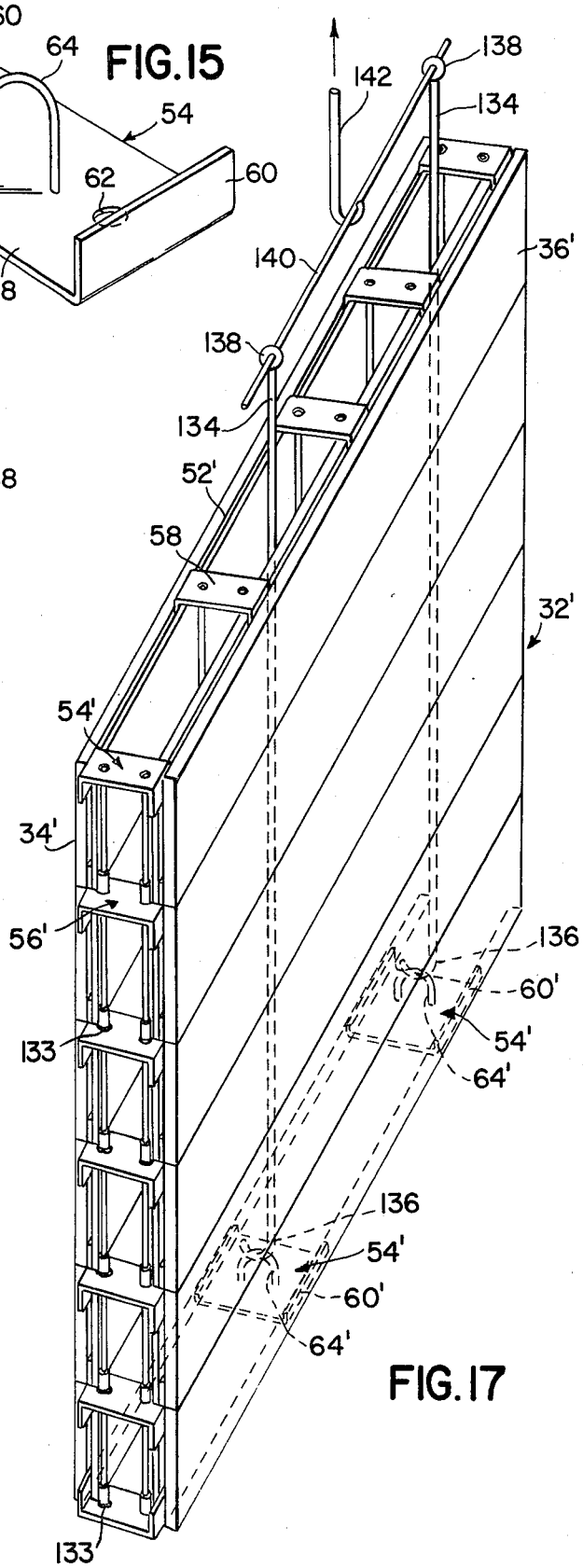
FIG.17

REINFORCED MASONRY CONSTRUCTION

BACKGROUND OF THE INVENTION

In the construction of reinforced masonry walls and/or concrete slabs, it has been conventional practice in the past to erect spaced temporary forms, between or upon which standard reinforcing members are placed, following which approximatey 150 pcf. density of high structural strength concrete is poured between or upon the forms, and vibrated.

After the forms are erected, or as they are in the process of being erected, portions thereof are cut out for mechanical or electrical egress and door and window frames are attached for openings by means of built-in bucks. Cutting these forms results in costly repair if the forms are to be reused.

After the concrete cures, the forms are removed, requiring a time element which is costly, and finishes are usually applied to one or both outer faces of the resulting section. If the exposed face is to be used as a flat finish, the surfaces must be pointed up where snap ties are broken off, which hole areas are noticeable without a supplementary finish, and act as a capillary conduit for moisture through the wall.

If the walls are to be considered waterproof, an additional treatment must be applied to the face exposed to the elements. If the walls are a part of a residence, architectural concrete finishes must be applied or provided by form liners, resulting in additional expense in time and material, and damage thereto.

Since conventional concrete walls or slabs do not provide sufficient insulation value to meet today's standards for energy conservation, additional applications of insulation must be applied requiring an additional application to the interior face for a finished wall surface, involving even greater time and expense. In the case of roof slabs, additional insulation and wearing surface must be added. Any use of conventional concrete automatically dictates 30% additional weight (as compared to the same section in structural grade cellular concrete) is added to the dead load imposed upon the reinforcing, structural framework and/or foundations.

In the construction of conventional masonry walls, the physical time and cost factors are even less favorable than set out above. Finishes are usually restricted to exposed brick or hollow block, or applied finishes such as stucco or additional precast finishes. The thickness of the load-bearing walls must be greater than concrete and reinforced concrete beam and column sections must be provided within the masonry section resulting for it to be considered load-bearing. This involves extra trades in addition to the wet trades, which slow down a job to a considerable degree and also increase its costs both in material and labor.

Besides a marked inferiority in load bearing capability as compared to reinforced concrete, conventional masonry construction has little or no resistance or lateral stress. Hollow block masonry is particularly susceptible to moisture invasion, as well as vermin, and has little value in fire rating or as an insulating factor against sound or thermal conduction. In consideration of these defects, conventional masonry must be reinforced, and additional applications be made to its surfaces, both inside and outside, to overcome its weaknesses and gain some portion of the aesthetic and physical properties noted above.

SUMMARY OF THE INVENTION

The present invention relates to reinforced masonry construction for walls and slabs which, although constructed as a composite section of lightweight, low and high density concrete, is stronger than conventional high density concrete structures, while at the same time characterized by superior insulating, waterproofing, sound and fireproofing qualities, and very appreciable savings in deadweight of the sections resulting.

The present reinforced masonry construction basically comprises spaced permanent forms in the case of walls, and a permanent form and a topping in the case of slabs, the space between the forms or forms and topping being filled with low density cellular concrete. In the case of slabs, the monolithic topping, or skin, of high strength, lightweight cellular concrete acts as the opposite composite face to the form panel below.

Each form includes a plurality of elongated panels joined in edge-to-edge relation, opposed panels being connected by ties and composite connectors which span and engage the panels to hold them in position. Each panel comprises a body portion which is preferably made of structural grade cellular concrete reinforced by a truss positioned therein. The peripheral edges of the panels are provided with splineways which are engaged by a portion of the ties to position the panels. The outer faces of one or both forms may be prefinished.

The ties connecting the panels are vertically or horizontally aligned, and reinforcing rods of unitary or multi-part construction, and need for outside scaffolding is obviated in the erection of walls. Trusses may be inserted between adjacent ties and engaged with the reinforcing rods for added structural strength. If desired, the elongated panels, ties and reinforcing rods may be welded, or secured together in any other suitable fashion to provide a gang-formed wall or slab form which may be prefabricated and transported to a building site.

The reinforcing rods, ties and reinforced panels of the present invention are interconnected in a manner to form walls and slabs of superior strength. When lightweight cellular concrete is poured between the forms of a wall, or onto a form of a slab, the reinforced form panels, ties and reinforcing rods form a composite structure of lightweight, yet strong construction. The present construction further permits greater versatility by using lightweight cellular concrete through its entire density range, resulting in an almost unlimited range of physical benefits in weight, sound, thermal insulation, fire, shock, etc.

Locking plates are provided to effect securement of adjacent panels together in uniplanar or angular relationship to prevent separation thereof during pouring of the concrete into the void between forms.

DESCRIPTION OF FIGURES OF THE DRAWINGS

FIG. 14 is a perspective view of a tie member and reinforcing rods constructed in accordance with the present invention;

FIG. 15 is a perspective of a tie member adapted for placement on a slab or footing and at the top of a wall constructed in accordance with the present invention;

FIG. 16 is a perspective view of a truss forming a part of the present invention, and illustrating the application thereof in a wall section;

FIG. 17 is a perspective view of a gang-form wall section comprising a modified form of the present invention;

DETAILED DESCRIPTION OF THE INVENTION

Figure 1:
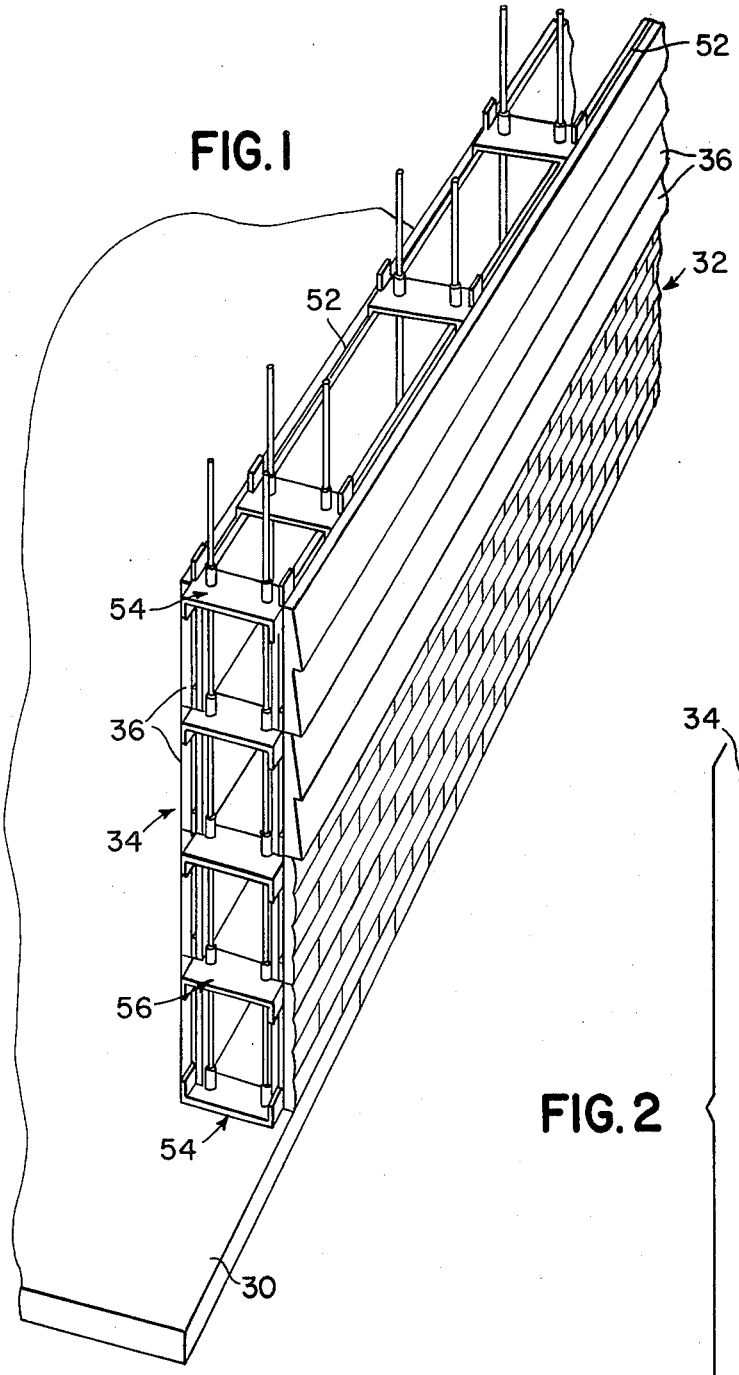
FIG. 1 is a perspective view illustrating the manner of constructing a masonry wall in accordance with the present invention.

The present invention relates to a reinforced masonry system and its ability to provide walls and slabs by the utilization of a unique interconnected series of component parts acting as connection devices and structural trusses in concert with both low and high density cellular concrete over the full range of its density, which is capable of providing greater strength to its resultant section than the same section in conventional high density reinforced concrete, while at the same time being characterized by superior insulation, waterproofing, sound and fire proofing qualities at considerably less weight and at less cost in time and money.

This system for building walls and slabs employs a minimum of components, including spaced-apart exterior and interior permanent wall forms as well as the form for slabs, which preferably comprise a plurality of precast panels of uniquely reinforced cellular concrete of equally high compressive strength as compared to conventional high density structural grade concrete, but at 30% saving in weight and the ability to have the surfaces prefinished in a very wide range of aesthetic choice. These panels may be cut, drilled or sawed easily with conventional masonry tools, which elminates the requirement for fixed modular construction.

The exterior and interior wall forms, as well as the slab form, comprise a plurality of elongated panels of a size and weight to be manually positioned to erect the wall or slab forms, the opposed panels of the wall form and the undersurface of the slab forms being interconnected by a plurality of metal ties which engage the longitudinal edges of adjacent panels to position successive rows of prefinished panels comprising each wall form, or to suspend the panels forming the underside form of the slab as well as its prefinished surface. The wall ties engaged in the panels are arranged in aligned groups, vertically for walls and horizontally for slabs, and reinforcing members through the wall ties from the top to the bottom of the wall to form a structural column. In slabs, the same procedure may be followed and connected to the beam or wall support by positive engagement to horizontal and vertical reinforcement.

The formation of these wall or slab sections can be prefabricated off the job site into what is known as a "gang-form" section if desired, and large sections set in place by cranes. These sections can actually be welded together internally, an ability inherited from the unique truss member reinforcing each plank. If manual erection for walls is preferred, or is required in order to eliminate the need for hoisting equipment, it is possible to completely eliminate the need for outside scaffolding and avoid the interference that might be caused by full length vertical reinforcing by employing short sections of rod furnished with tubular sections on one end, so that the rods may be coupled together with positive structural splicing means to "grow" vertically as the wall is erected. This eliminates the need for outside scaffolding in the erection of a wall section.

The composite section of walls, or slabs, if the core is designed as a low density type, is completed by pouring or pumping in a preferred fill of low density cellular concrete. This density is usually at the opposite end of the density range to that making up the panels, rendering the system unique in the use of a single material used in its widest density range to create all the physical characteristics required to offer waterproofing, strength, fireproofing, sound and thermal insulation, as well as aesthetic choice in finished surfaces. This composite arrangement enables the construction of masonry walls and slabs, wherein the forms become a permanent part of the wall or slab, and wherein, by virtue of the arrangement of the structural components, a load-bearing wall or slab of superior strength may be constructed with the composite section of high and low density cellular concrete rather than entirely high density concrete, thus achieving superior physical properties and values except for strength.

Naturally, the strength of the wall is vastly increased as the density of fill is increased, but this is not required by the system since the unique trusses and their interrelationship with the other structural components, permits the lightest weight to strength ratio available, one which far exceeds the normal strength factors for building walls and slabs today.

When greater strength is needed in walls or slabs, e.g., in multi-level structures or for high concentrated loading, trusses or additional trusses as in the case of horizontal beams or columns, may be inserted between the tie members, or used in continuous forms, which trusses are engaged with the ties by means of threading the reinforcing through the holes therein and at the same time passing through the circular heads of the trusses' cords to create what could be considered small reinforced Lally columns when cellular concrete is poured between or upon the form. Since the composition of the material is very fluid, it is permitted to run inside the circular head of the truss as well as all about it and the reticulated web of the truss. This ability permits the section's strength to be increased at a miniscule extra weight and retain the extra physical qualities of the low density fill.

The composite section of the system provides greater durability in that it has markedly superior stability in freeze-thaw durability and the advantage to work in cold weather that would prevent conventional concrete or masonry construction, since cellular concrete has the lowest free water and very low water absorption, hence superior weatherability. It is the lightest in weight to any other structurally comparable system which reflects added savings in structural framework and to foundations. Cellular concrete has been proven far more resistant to the effects of salt than conventional concrete, and also has better impact, blast and seismic energy absorption and shock mitigation reaction.

In certified comparable tests, cellular concrete has been rated as impermeable by hydrostatic tests and building code acceptance, wherein conventional dense structural grade, as well as ferro-concrete, failed. The system in its composite section offers far greater and proven protection against moisture penetration, thermal conductivity, fire resistance and sound apsorption as well as complete freedom of design in aesthetics. It is faster, cheaper and stronger than comparable conventional means due to the unique design of its trusses and their interrelation with the other components of the system. These factors are all enhanced in the final composite creation by the additional of the cellular concrete fill placed within the forms, which addition also completely braces the structural and/or reinforcing means, adding extra strength thereto, since, in the case of walls, the unsupported length of the vertical column members is reduced virtually to zero.

The system is structurally unique in its composite form inasmuch as it can be easily urged that it can be considered in any one of three structural categories, i.e., as a "reinforced sandwich panel", as "reinforced concrete", or as a "structural framed wall" braced by the fill completely through and around all its parts and members. The fill greatly enhances the value of the systems, components, and vice-versa. One of the structural phenomena of the system is that it is in itself a combination of the three means outlined above, receiving contributions from each to achieve it ultimate, superior strength, and related physical criteria advantages.

DESCRIPTION OF FIGURES OF THE DRAWINGS

In FIG. 1, there is illustrated the manner of constructing a masonry wall for a building structure on a slab 30. In accordance with this invention, there is provided an exterior wall form 32 and an interior wall form 34. Exterior and interior wall forms 32 and 34 include a plurality of precast panels 36 of basically the same construction, but wherein the outer surface of one or both forms may be prefinished in a virtually unlimited variety of finishes, such as a brick finish or a shiplap finish as illustrated.

Referring to FIGS. 8, 9, 10 and 13, it will be seen that precast panels 36 are of elongated rectangular configuration and of a size to permit them to be manually set in position in a wall or slab section. A panel of 12 inches high, 10 feet long and $1\frac{1}{4}$ inches thick has proven satisfactory in use.

Panel 36 includes a body portion 38 which is precast of lightweight cellular concrete of high density, i.e. above 60 pcf. One face of body portion 38 is prefinished by providing a shiplap design as shown, or other suitable facing design.

It is a salient part of the present invention to provide a reinforcement truss 40 which is integrally formed in body portion 38. Truss 40 includes an elongated reticulate body 42 of expanded metal construction, the longitudinal edges of which are engaged by an imperforate J-shaped metal member which includes a main portion 44, an angular portion 46 extending outwardly at a 90° angle to main portion 44, and an upturned flange portion 48 issuing from the angular portion and lying in spaced, parallel relation to reticulate body 42.

Figure 8:
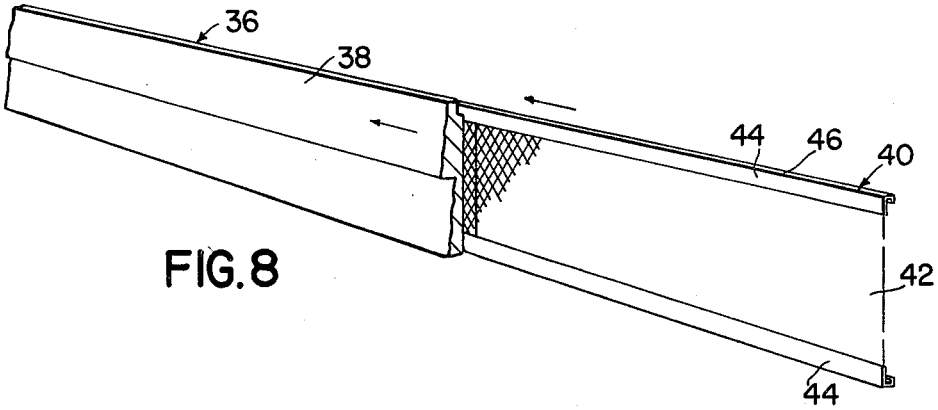
FIG. 8 is a perspective view of a precast wall panel constructed in accordance with the present invention, a portion thereof being broken away to show details thereof.
Figure 9:
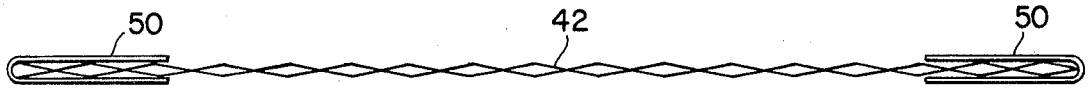
FIG. 9 is an end elevational view of the arrangement of parts for making the reinforcing truss used in the wall panel and flood slab of the present invention.

Referring now to FIG. 9, it will be seen that truss 40 is formed by placing the longitudinal edges of reticulate body 42 into elongated metallic clips 50 of U-shaped cross section. Members 50 and the edges of reticulate body are then crimped together and bent to the J-shaped configuration shown in FIG. 8. No welding or other securing means is necessary to bond the clips to the reticulate body.

Figure 13:
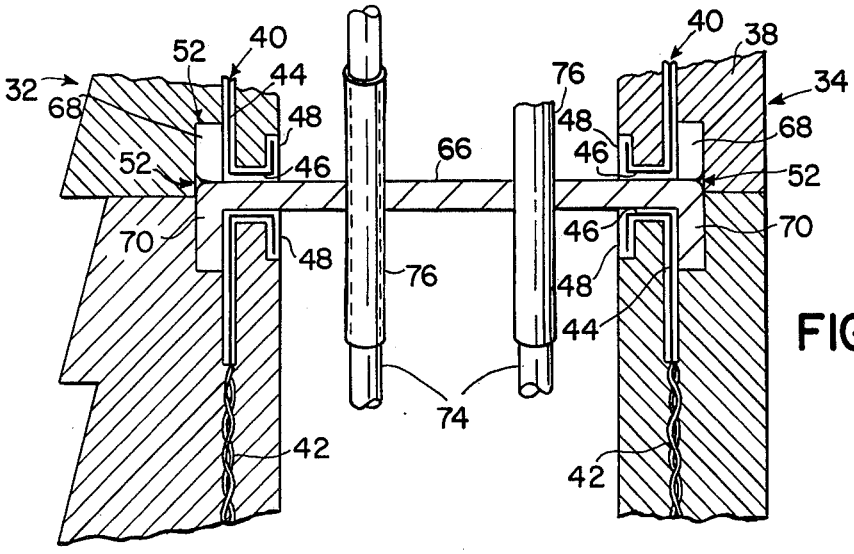
FIG. 13 is an enlarged fragmentary transverse sectional view of the wall illustrated in FIG. 1, showing details of construction.

Referring to FIGS. 8 and 13, it will be seen that truss 40 is substantially coextensive with the height and length of body portion 38 and is positioned in the body portion in greater proximity to the rear face thereof. As shown in FIG. 13, main portion 44 is so located to form one side of a splineway 52 which extends around the entire periphery of body portion 38. Also angular portion 46 forms the outer top and bottom surface of body portion 38 and lies upwardly of the upper and lower limits of the concrete portion of the panel for reasons which will be hereinafter more fully set out. Also flange portion 48 forms the limit of the inner face of panel 36. This arrangement of the truss in the body portion maintains the integrity of the concrete body portion and permits welding of the panel to other metal components of the composite structure. If desired, the J-shaped member may be perforate to effect a better bond with concrete to and through it.

In order to hold the wall panels comprising the exterior and interior wall forms in predetermined spaced relation, and to support the panels, there are provided ties 54 which are adapted for placement on slab 30, and ties 56 for positioning between superjacent panels.

As shown in FIG. 15, tie 54 is of generally U-shaped configuration and includes a body portion 58, the ends of which are bent upwardly to provide tabs 60 adapted for insertion into splineway 52 of panels 36. Spaced circular openings 62 are provided in body portion 58 between which is a hook 64, the ends of which are fixed to body portion 58.

Figure 12:
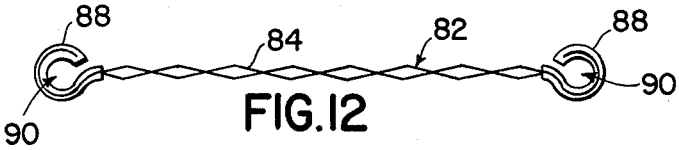
FIG. 12 is an end elevational view showing the completed truss of FIG. 11.

Tie 56 is shown to advantage in FIG. 12 and includes a body portion 66, each end of which is bent to provide opposed upwardly extending tabs 68 and opposed downwardly extending tabs 70. Body portion 66 is provided with a pair of spaced circular openings 72.

As shown to advantage in FIG. 1, base ties 54 are placed on slab 30 in spaced relation to each other, following which exterior form panel 36, either finished or unfinished, is placed thereon so that a tab 60 engages splineway 52 of the panel. A second panel, either finished or unfinished, comprising a part of the interior wall form is engaged with tab 60 at the opposite end of base tie 54. This spaces the panels, comprising part of the interior and exterior wall forms, a predetermined distance apart, such as 6 or 8 inches, thereby forming a void therebetween. Ties 56 are then placed on exterior and interior form panels to connect the same, engagement being effected by inserting tabs 70 into splineway 52 of panels 36.

In accordance with the present invention, reinforcing rods are adapted to be trained through openings 62 of ties 54 and openings 72 of ties 56. These reinforcing rods may be of unitary construction, but, in order to facilitate erection of the interior and exterior wall forms from one side of the wall, and thereby avoid exterior scaffolding, it is preferable that a plurality of short rods 74 be employed, the length of each rod being substantially equal to the height of panels 36. In connection with rods 74, there are provided short tubular members 76 into which the ends of superjacent rods 74 are placed, the tubular members being adapted to extend through opening 52 of ties 54 and 72 of ties 56. Weld 78 are other suitable stop means is located at approximately the midpoint of the interior of the tubular members 76 to limit the degree of entry rods 74 into the same. Therefore, after panel 36, which is farthest removed from the installer, is positioned on tabs 70 of ties 56, short rods 74 are inserted into tubular members 76, following which the near panel 36 is positioned in opposed relation to the first panel. In this way, the reinforcing rods do not interfere with the installation of panels farthest away from the installer.

When the uppermost panel has been placed in position, ties 54 may be placed in inverted position with tabs 60 engaging splineway 52 to hold the top of the wall against movement.

Low density, i.e. below 50 pcf, cellular concrete 80 is then poured into the void between wall forms 32 and 34 and flows between and around the wall ties and reinforcing rods, engages the opposed faces of the exterior and interior walls, and flows into splineway 52. A composite structure is thereby formed including the reinforced panels, the metal ties, the reinforced rods and cellular concrete. The reduced height of truss 40 permits ties 54 and 56 to be inserted readily which ties do not extend above the upper limit of panel 36.

Figure 11:
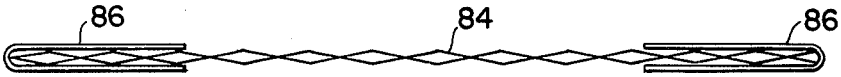
FIG. 11 is an end elevational view similar to FIG. 7 of the arrangement of parts for making the truss for use in a wall, or as slab reinforcing.

In FIGS. 11, 12 and 16, there is illustrated a truss 82 adapted for use in the construction of a multilevel building structure wherein greater wall strength is desired. As shown in FIGS. 11 and 12, truss 82 is formed by providing a reticulate body portion 84 of rectangular construction, the longitudinal edges of which are inserted into elongated imperforate clip members 86 of U-shaped cross section. Members 86 are crimped together and rolled to form tubular portions 88, each having a central opening 90 adapted to receive reinforcing rods 74 and tubular members 76.

Trusses 82 are substantially equal in height to panels 36 or a distance between adjacent ties, so that a truss is positioned for each row of panels added to the exterior and interior forms. A continuous truss is thereby provided from the top to the bottom of the wall or transversely from one side to another of the slab.

Figure 2:
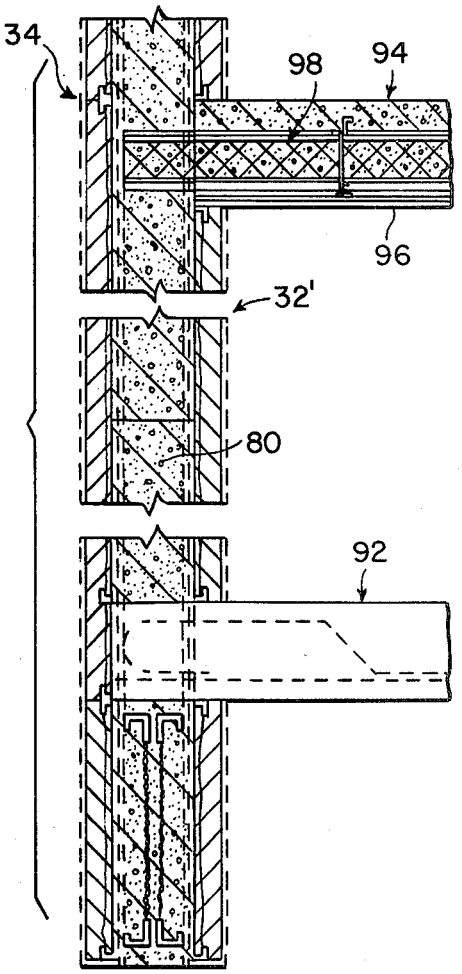
FIG. 2 is a fragmentary longitudinal sectional view of wall and floor slab sections constructed in accordance with the present invention.
Figure 3:
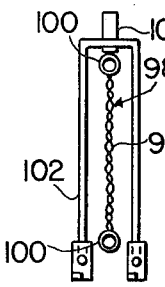
FIG. 3 is an end elevational view of a horizontal truss member, that may be employed in the floor slabs of the present invention.
Figure 4:
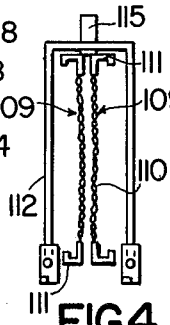
FIG. 4 is a view similar to FIG. 3 showing an alternate truss.
Figure 5:
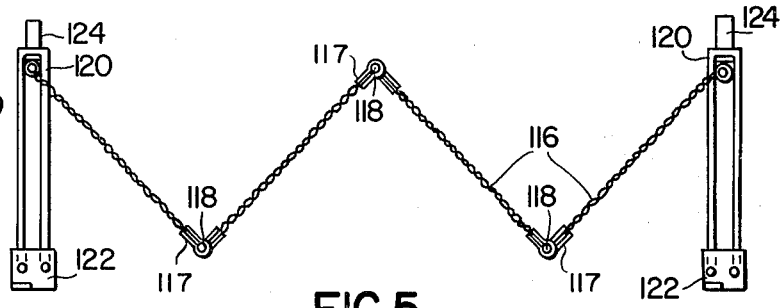
FIG. 5 is an end view illustrating a further modified form of truss for a floor slab.
Figure 7:
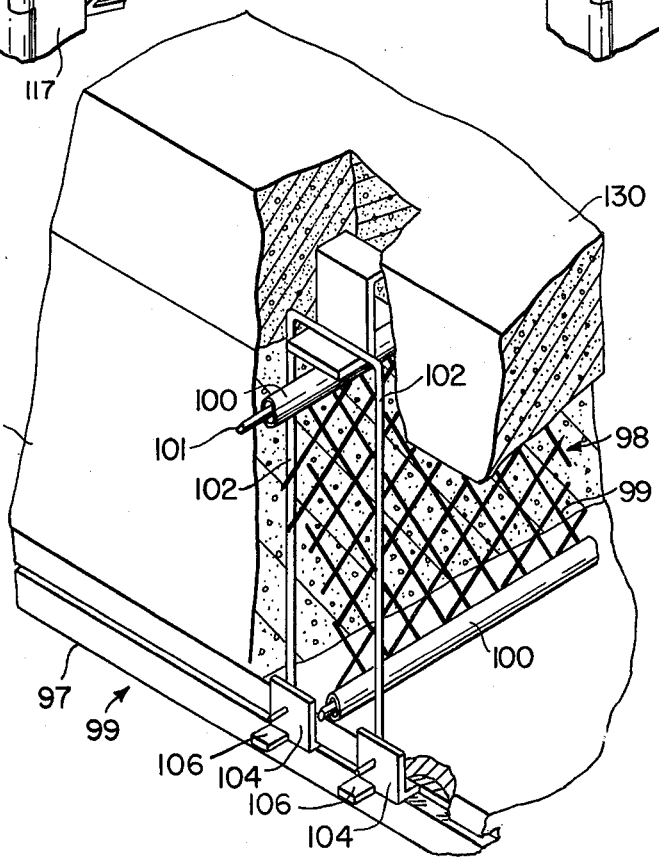
FIG. 7 is an enlarged perspective view of a portion of a slab showing the advantage of a hanger clip.

In FIG. 2, there is illustrated the application of the present invention in forming not only the walls of the structure but also to be used in connection with a conventional floor slab 92 or floor slabs 94 formed in accordance with the present invention, including lower panel forms 96 which is of the same construction as the wall panel form illustrated in FIG. 8. A plurality of truss chords 98 are positioned on forms 96 and extend transversely of the latter. The truss chords may be of various types which are illustrated in FIGS. 3, 4 and 5 of the drawings. In FIGS. 3 and 9 the truss chord illustrated is similar to the truss illustrated in FIG. 10 and includes a reticulate body portion 99, the longitudinal edges of which are formed to provide tubular portions 100. An inverted U-shaped wire hanger clip 102 is placed over the truss chord, and right angle clips 104 are secured to the terminals thereof. The free ends of the clips are provided with tabs 105, 106 which face in opposite directions and are adapted for insertion into the splineways 97 of adjacent panel forms 96. Composite clips 108 of Z-shape are engaged with the intermediate part of hanger clips 102, the lower part of the Z shape composite clip engaging the hanger clip as shown in FIG. 7, so that the upper part of the composite clip extends above truss chord 98 for purposes which will be hereafter set out.

In FIG. 4, there is illustrated another form of truss chord including a pair of adjacent trusses similar to that illustrated in FIG. 8. Each truss is designated 109 includes a reticulate body portion 110, the longitudinal edges of which are formed to provide J-shaped edge members 111. A hanger clip is indicated at 112 and right angle clips similar to clips 104 are designated 114. A composite clip similar to clip 108 is indicated at 115.

Figure 6:
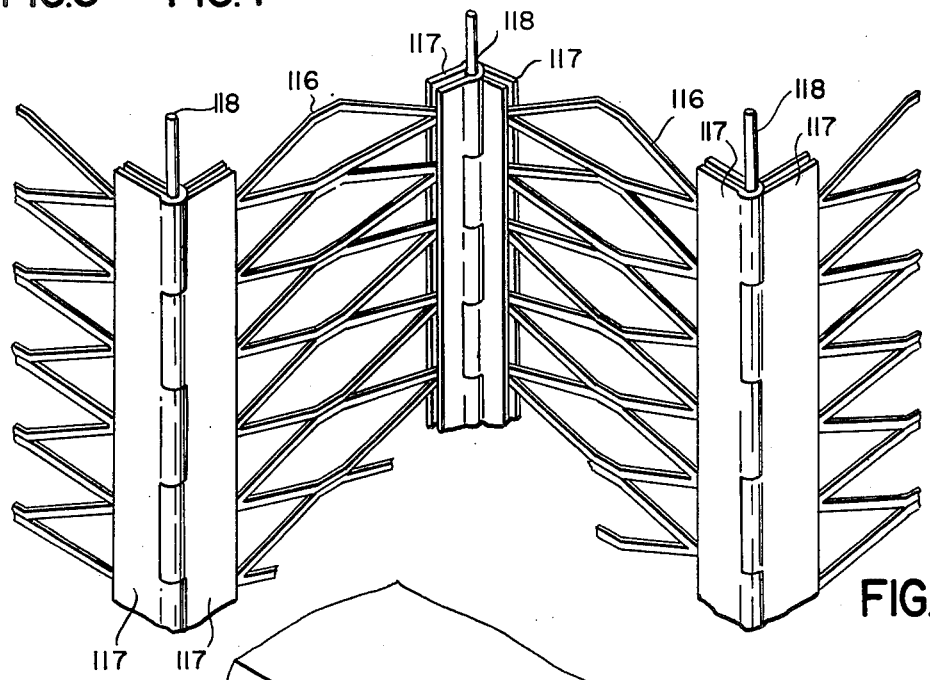
FIG. 6 is a plan view of the truss of FIG. 5.

In FIG. 5, there is illustrated still another form of truss chord which is of W-shaped configuration and includes a series of connected truss members, each of which includes a reticulate body portion 116 and clip members 117 in fixed engagement with the longitudinal edges thereof. As shown in FIG. 6, clip members 117 are notched at intervals for interconnection with adjacent truss members, to provide a piano hinge effect, a reinforcing rod 118 is threaded through the notched and interconnected clip members to produce a hinge effect which permits the truss chord to be shipped in folded or flat condition.

Figure 10:
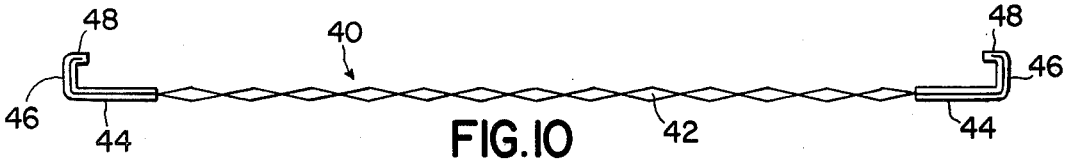
FIG. 10 is an end elevational view similar to FIG. 9, showing the completed truss.

It will be further noted from FIG. 2 that truss chords 126 are of the type illustrated in FIG. 10 welded together and positioned between walls 32 and 34 as a beam reinforcement member. Low density cellular concrete 127 is poured through and around truss chords 126. Additional low density cellular concrete 80 is poured above the truss chords between walls 32 and 34.

Low density cellular concrete 128 is poured on top of panels forms 96 to approximately the top of the truss chord. High strength cellular concrete 130 is poured on top of cellular concrete 128 and engages the composite clips connected to the truss chords to form an outer "skin" to complete the composite structural section. If desired, the skin section may be additionally reinforced in the direction opposite to the direction of the truss chords to provide the equivalent reinforcement found in the panel form 36, or simply to provide temperature control in the skin. This depends on the span of the upper skin between truss members.

In FIG. 17, there is illustrated a gang-form wall section constructed in accordance with the present invention, which wall section embodies structural components similar to those employed in the construction of a wall of FIG. 1, which parts are identified by like, prime numbers. In this form of the invention, tubular members 76' are welded to ties 54' and 56' as indicated at 133 and ties 54' and 56' are welded to metal portions 44' and 46' of panels 36' so that a monolithic structure is thereby formed, the parts of which will not separate when the wall section is moved as a unit.

For moving the wall section, there are provided a pair of spaced tie members 54' which are placed beneath the lowermost panels of the interior and exterior wall forms, the upstanding tabs 60' thereof extending into the splineways of the panels. Inverted U-shaped hooks 64' extend upwardly between exterior and interior wall forms 32' and 34'. Spaced rods 134 extend downwardly between the exterior and interior wall forms, the lower ends of which rods are provided with bills 136 adapted for detachable engagement with hooks 104'. The upper ends of rods 134 are formed to provide eyes 138, which eyes are adapted to receive a transverse lifting rod 140 extending therebetween. A hook 142 connected to a suitable crane permits the gangform section to be lifted as a unit and transported to the construction site whereupon rods 134 are removed preparatory to pouring low density cellular concrete between wall forms 32' and 34'.

By using the gang-form method of construction, wall and slab sections may be rapidly positioned and the concrete poured into place to effect erection of a structure in a minimum of time.

In FIGS. 18 to 23, there are illustrated various means for connecting wall sections together at right angles thereto to form the structure corners.

Figure 18:
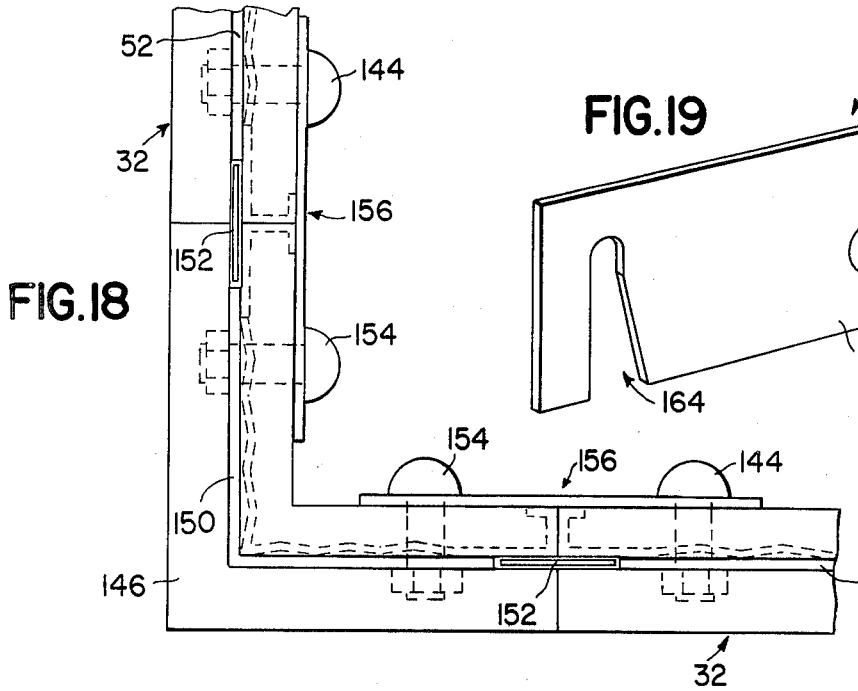
FIG. 18 is an enlarged top plan view of a corner section employed to connect wall sections at right angles to each other.

In FIG. 18, there is illustrated outer wall form sections 32 which are disposed in spaced angular relationship to each other, the inner faces of the forms being provided with lug and washer assemblies 144 which are cast in place adjacent the lateral edges of the panels. A corner section preferably of prefabricated construction is indicated at 146 having a right angular body portion 148 which is preferably of precast reinforced cellular concrete and provided with a peripheral splineway 150. Flat connectors 152 are placed in the vertical portions of the splineway of corner sections 146 and panel forms 32 to hold the latter in proper position. Lug and washer assemblies 154 are precast to angular portions of section 148 in opposed relation to lugs 144 of sections 32.

A connector 156 extends between and is connected to lugs 144 and 154 to fixedly secure corner section 146 to sections 32. Connector 156 includes a flat rectangular body portion 158 provided adjacent one edge thereof with a keyhole-shaped opening including an enlarged circular opening 160 of a size to permit lugs 144 or 154 to pass therethrough, and a narrower recess 162 extending upwardly from opening 160 which is smaller than the head of lugs 144 and 154 for receiving the lug shank.

In spaced relation to the keyhole-shaped opening is an elongated slot 164 for gradually decreasing width which extends from a longitudinal edge of flat body 158 transversely thereof for a substantial distance of the body's breadth. At the longitudinal edge of connector 156, slot 164 is wide enough to accommodate the head of lugs 144 and 154 but then progressively decreases in size until it can accommodate only the lug shank.

Connector 156 is readily applied by inserting lugs 144 and 154 through circular opening 160 and into the widest portion of slot 164 following which the connector is driven downwardly so that the shank portions of the lugs are driven into narrowed recess 162 and the narrowest portion of slot 164 to fixedly hold the same in position.

Figure 20:
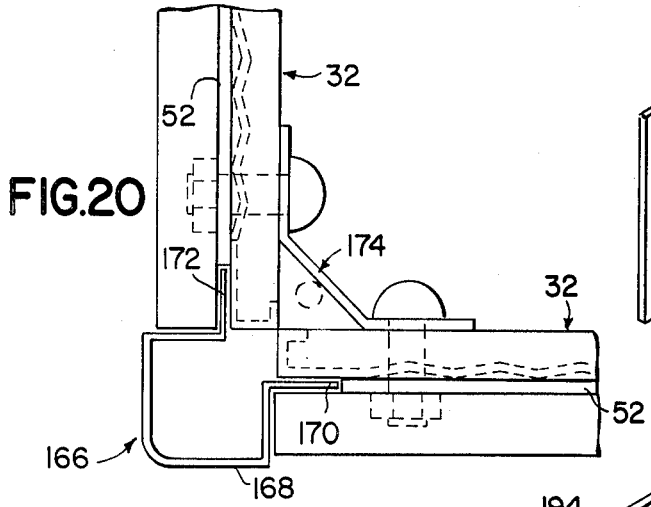
FIG. 20 is an enlarged top plan view of a modified form of the corner section shown in FIG. 16.
Figure 21:
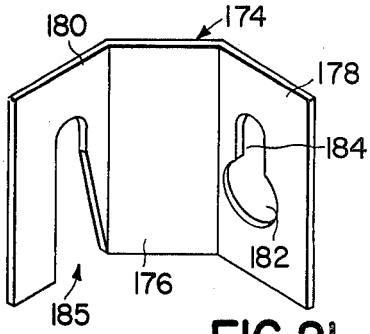
FIG. 21 is an enlarged perspective view of a connector plate employed in connection with the corner section of FIG. 18.

In FIG. 20, there is illustrated an alternate form of exterior corner section which includes a preferably extruded section 166 including an elongated body 168 of generally square cross-section, adjacent sides of which are provided with extensions 170 and 172 at approximately midway of the side's length, which extensions are bent outwardly into splineways 52 of sections 32. To hold the sections 32 in contiguous relation, there is provided a connector 174 including a central flat body portion 176 from the lateral edges of which extend angular flat body portions 178 and 180, both of which extend at a 45° angle to body portion 176.

Figure 19:
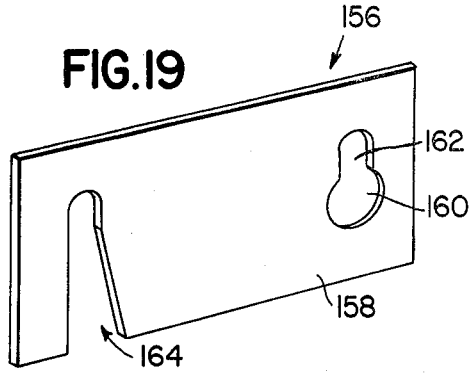
FIG. 19 is an enlarged perspective view of a connector plate employed to join the corner section of FIG. 18 to wall sections arranged at right angles to each other.

Angular body 178 is provided with a keyhole-shaped opening comprising a large circular opening 182 and a narrower recess 184 extending upwardly therefrom just as in the form of invention illustrated in FIGS. 18 and 19. Similarly, a converging elongated slot 185 is provided in angular portion 180.

Connector 174 is fixedly engaged with lugs 144 of sections 32 by driving the connector thereon in the same manner as described above in connection with FIGS. 18 and 19.

Figure 22:
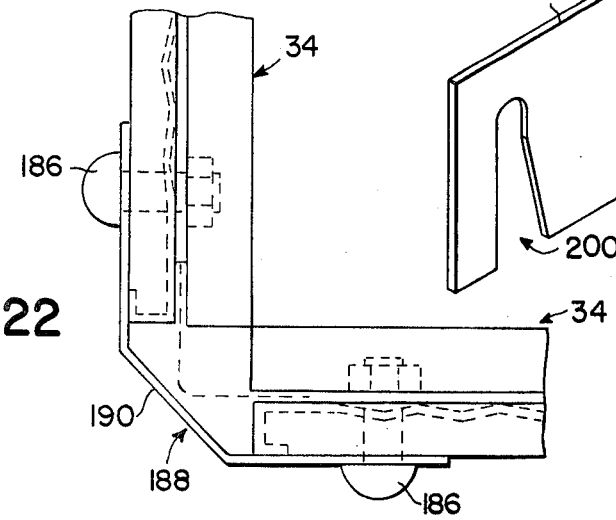
FIG. 22 is an enlarged top plan view of another modified form of the corner section for joining interior wall sections at right angles to each other.
Figure 23:
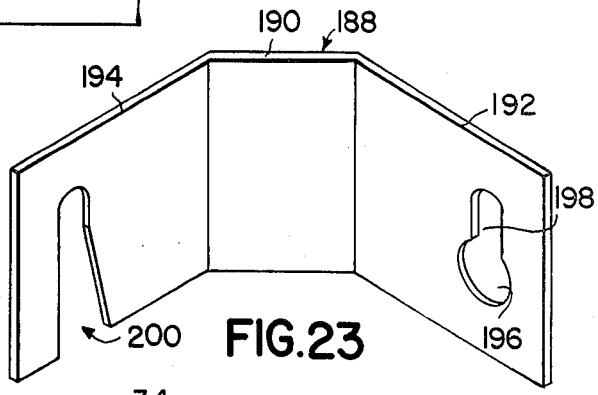
FIG. 23 is an enlarged perspective view of a connector plate employed with the corner section of FIG. 20.

In FIGS. 22 and 23, there is illustrated a means of connecting inner wall form sections 34 together at right angles, wherein lug and washer assemblies are precast in one face of forms 34 adjacent the lateral margins thereof. A connector for joining the form sections together is indicated at 188 and includes a central body portion 190 and angular body portions 192 and 194 which are disposed at 45° angles to central body portion 164. The connector of this form of the invention is similar to that shown in FIG. 21 with the exception that angular body portions 192 and 194 are wider due to the increased spacing apart of lugs 186 of sections 34. Body portion 192 is provided with a keyhold-shaped opening comprising an enlarged opening 196 and a smaller recess 198, extending upwardly therefrom. Angular body portion 194 is provided with a gradually converging slot 200 extending transversely from an edge thereof.

The concrete construction of the present invention enables cellular concrete to be used over a wide range of the density thereof in order to effect variations in strength, insulation, waterproofing, etc. of the components thereof. The composite section made in accordance with the present invention is approximately eighty percent lighter in a total six inch section than its counterpart in conventional structural grade reinforced concrete section.

Due to the fluid nature of cellular concrete, containing no large stone or rock aggregate, it may be pumped into place much easier than conventional concrete and achieve a homogeneous mass without the need of vibration, an operation which can be damaging both to the concrete and the forms of conventional construction. At the same time, the resultant structure provides better thermal and sound insulation, and fireproofing characteristics than has heretofore been possible.

In those instances where insulation against moisture invasion, sound and thermal conduction is not a factor, the use of structural grade cellular concrete throughout the structure produces a reinforced masonry structure which is stronger than conventional concrete construction.

The foregoing description shows the present invention in its preferred forms, considering all the physical properties described. However, it is obvious that the sections shown in FIGS. 1 and 17, when welded as provided by the component parts (panel reinforcing as shown in FIG. 8) and together as shown in FIG. 13, are versatile and can be employed as a section of Hollow-core or cavity wall masonry reinforced in its cavity void, and can be used as a structural wall section. This reduces some of the structural strength, thru-wall sound and thermal insulation, fire values, etc., as described above, but can be used for walls not requiring these features in ultimate form. In this application, the air between the spaced walls serves as an insulating agent.

Where use dictates, the void, or cavity wall type of reinforced masonry construction may have its thru wall insulating value increased by using lower density materials in lieu of air or the cementitious fill recommended. This type of alternate fill can be cellulose, styrofoam, fiberglass, urethane, etc.

It must be borne in mind that while this type wall would offer the ultimate thermal and sound insulating valve (for cold storage, residences in extremely cold or hot climates), it does lose, proportionally, structural strength, fire proofing value and protection from noxious fumes.

While there has been herein shown and described the presently preferred forms of this invention, it is to be understood that such has been done for purposes of illustration only, and that various changes may be made therein within the scope of the appended claims.

What is claimed is:

1. Reinforced masonry construction for walls and slabs including (a) a pair of skins spaced a predetermined distance apart in opposed relation (b) at least one of said skins comprising a plurality of preformed elongated panels arranged with the longitudinal edges in contiguous relationship (c) each of said panels comprising a body portion of cementitious material (d) the peripheral edge of said body portion being formed providing a splineway (e) said panel further including a reinforcing truss embedded in said body portion, which truss is substantially coextensive with the length and breadth of said body portion (f) reinforcing means extending between, and engaged with, said skins (g) said reinforcing means including a portion engaged with said skins for interconnecting the same, (h) one end of said reinforcing means being positioned in the splineway of said panel, and (i) an insulating agent in those spaced between said skins.

2. The reinforced masonry construction of claim 1, wherein:

(a) the body portion of each of said panels is constructed of cellular concrete, and (b) said insulating agent is cellular concrete.

3. The reinforced masonry construction of claim 1, wherein:

(a) one of said skins includes a cementitious topping applied to the cementitious material between the skins.

4. The reinforced masonry construction of claim 1 wherein:

(a) said reinforcing means includes a tie extending between said skins.

5. The reinforced masonry construction of claim 1, wherein:

(a) said reinforcing means includes a truss chord.

6. The reinforced masonry of claim 5, wherein:

(a) said truss chord includes an elongated reticulate portion (b) edge members engaged with the longitudinal edges of said reticulate portion (c) said edge members being of tubular conformation (d) reinforcing rods extending through said tubular edge members (e) hanger clips engaged with said truss chord (f) a portion of each of said hanger clips being engaged with said elongated panels, and (g) composite clips carried by said hanger clips and including portions engageable with the skin in opposed relation to said elongated panels.

7. The reinforced masonry construction of claim 5, wherein:

(a) said truss chord includes a pair of sections arranged in back-to-back relation (b) each of said sections including a reticulate portion (c) edge members engaged with the longitudinal edges of said reticulate portion (d) said edge members being of J-shaped conformation in cross section (e) hanger clips engaged with said pair of sections (f) a portion of each of said hanger clips being engaged with said elongated panels, and (g) composite clips carried by said hanger clips and including portions engageable with the skin in opposed relation to said elongated panels.

8. The reinforced masonry construction of claim 5, wherein:

(a) said truss chord includes a plurality of sections (b) each of said sections including an elongated reticulate portion (c) edge members engaged with the longitudinal edges of said reticulate portion (d) the outermost portions of said edge members being notched at intervals for interfitting engagement with adjacent sections (e) rods inserted through the notched portion of adjacent sections for hingedly connecting the same together (f) hanger clips engaged with the end truss chord sections (g) a portion of each of said hanger clips being engaged with said elongated panels, and (h) composite clips carried by said hanger clips and including portions engageable with the skin in opposed relation to said elongated panels.

9. Reinforced masonry construction for walls and slabs, including (a) permanent forms spaced apart a predetermined distance to provide a structural section (b) each of said opposed forms comprising a plurality of elongated, preformed panels arranged in rows with the longitudinal edges in contiguous relationship (c) the outer face of one panel being prefinished with a facing design (d) each of said panels including a body portion of cellular concrete, the peripheral edges of which are provided with a splineway (e) a reinforcing truss embedded in said body portion, which truss is substantially coextensive with the length and breadth of said body portion (f) said reinforcing truss including a reticulate body portion (g) edge members engaged with the longitudinal edges of said retriculate body portion (h) ties engaged with opposed panels of said forms and spanning the void therebetween, said ties being in vertically aligned relationship connecting each row of opposed panels for positioning said panels and spanning the void therebetween (i) each of said ties including a flat body portion having spaced openings (j) the ends of said flat body portion having angular tabs for insertion into the splineways of adjacent panels for positioning the latter (k) a pair of reinforcing rods extending through the openings of said body portion and extending transversely of the forms, and (l) cementitious material in the void between said forms.

10. The reinforced masonry construction of claim 9, wherein:

(a) said cemetitious material comprises low density cellular concrete.

11. The reinforced masonry construction of claim 9, with the addition of:

(a) means for fixedly securing form sections at a right angle to each other.

12. The reinforced masonry construction of claim 11, wherein:

(a) said means includes a right angle corner section interposed between said form sections (b) lugs cast in place in said form section and right angle corner section adjacent the lateral extremities thereof, and (c) connectors extending between, and engaged with, the lugs of said corner section and form sections, for fixedly securing said sections together.

13. The reinforced masonry construction of claim 11, wherein:

(a) said means includes lugs cast in place in said form sections, adjacent proximate edges thereof, and (b) angular connectors extending between and engaged with, the lugs of said form sections for fixedly securing said sections together.

14. The reinforced masonry construction of claim 13, with the addition of:

(a) a corner member inserted between the ends of the form sections and a body portion, and (b) extension members extending outwardly from said body portion into the panel splines of the form sections for holding the corner member in position.

15. The reinforced masonry construction of claim 13, wherein:

(a) said lugs and connectors are located interiorly of the right angle form sections.

16. The reinforced masonry construction of claim 13, wherein:

(a) said lugs and connectors are located exteriorly of the right angle form sections.

17. Reinforced masonry construction for walls and slabs, including (a) permanent forms spaced apart a predetermined distance in opposed relationship, leaving a void therebetween (b) each of said opposed forms comprising a plurality of elongated, preformed panels arranged in rows with the longitudinal edges in contiguous relationship (c) each of said panels including a body portion of cementitious material (d) a reinforcing truss embedded in said body portion (e) ties in vertically aligned relationship connecting each row of opposed panels for positioning said panels and spanning the void therebetween (f) each of said ties including a flat body portion (g) the ends of said body portion being adapted for engagement with opposed panels (h) the body portion of said tie being provided with at least one opening (i) a reinforcing rod extending through the vertically aligned ties for substantially the entire transverse dimension of the forms, and (j) An insulating agent between said forms engaged with said ties and reinforcing rod to provide a structure of high compression strength.

18. The reinforced masonry construction of claim 17, wherein (a) the body portion of each of said panels is high density cellular concrete.

19. The reinforced masonry construction of claim 17, wherein (a) the insulating agent between said panels is low density cellular concrete.

20. The reinforced masonry construction of claim 17, with the addition of (a) a truss positioned between, and engaged with, adjacent ties.

21. The reinforced masonry construction of claim 20, wherein (a) said truss includes a reticulate body portion of rectangular shape (b) edge members of U-shape cross section into which tie longitudinal edges of said reticulate body portion are inserted (c) said U-shape edge members and portions of said reticulate body portion inserted therein being crimped and rolled to form tubular portions (d) each of said tubular portions having a central opening adapted to receive said reinforcing rods.

22. The reinforced masonry construction of claim 17, with the addition of (a) means for fixedly securing together said panels, tie means and reinforcing rods comprising the forms, whereby said forms may be prefabricated and then moved to the site.

23. The reinforced masonry construction of claim 22, with the addition of (a) lifting means detachably engaged with said forms for transporting the same.

24. The reinforced masonry construction of claim 23, wherein (a) said lifting means includes a pair of spaced tie members positioned beneath the lowermost panels (b) the ends of said tie members having upstanding tabs extending into the splineways of said panels (c) inverted U-shaped hooks secured to said tie members and extending upwardly between said spaced panels
(d) spaced rods extending downwardly between said panels
(e) the lower ends of said spaced rods being provided with bills adapted for detachable engagement with said inverted U-shaped hooks
(f) a transverse lifting rod, and
(g) means connecting said transverse lifting rod with the upper end of said rods.

25. The reinforced masonry construction of claim 17, wherein
(a) said tie is provided with a second opening in spaced relation to the first opening, and
(b) a second reinforcing rod extending through the second opening of the vertically aligned ties.

26. The reinforced masonry construction of claim 25, wherein
(a) each of said reinforcing rods includes a plurality of short rod members, the length of each of which is substantially the same as the width of said panels and arranged in end-to-end relationship, and
(b) means for joining adjacent ends of said rod members together, whereby both of the spaced forms may be readily erected from one side thereof.

27. The reinforced masonry construction of claim 26, wherein
(a) said means for joining said short rod members includes a tubular member for receiving the ends of adjacent rod members.

28. A precast panel including:
(a) a rectangular body portion of cementitious material
(b) the peripheral edges of said body portion being provided with a splineway, and
(c) a reinforcing truss embedded in said body portion, which truss is substantially coextensive with the length and breadth of said body portion
(d) said reinforcing truss including a reticulate body
(e) said reinforcing truss further including edge members engaged with the longitudinal edges of said reticulate body
(f) a portion of said edge members defining one side of the splineway.

29. The precast panel of claim 28, wherein
(a) said rectangular body portion is precast of lightweight cellular concrete of high density.

30. The precast panel of claim 28, wherein
(a) one face of said body portion is prefinished with a facing design.

31. The precast panel of claim 28, wherein
(a) said edge members include elongated clips of U-shape cross section into which the longitudinal edges of said reticulate body are placed
(b) said U-shape edge members and portions of said reticulate body contained therein being crimped and bent to form the side of the splineway.

32. The precast panel of claim 31, wherein
(a) said edge members are bent into a J-shape conformation in cross section
(b) said J-shape edge members including a main portion, an angular portion and a reversely turned flange portion
(c) said main portion defining one side of the splineway of said body portion
(d) said angular portion extending rearwardly of the body portion and forming a part of the edge of said panel
(e) said reversely turned flange portion being in spaced, parallel relation to said main body portion and forming a part of the rear face of said panel.

33. Reinforced masonry construction for walls and slabs, including
(a) permanent forms spaced apart a predetermined distance to provide a structural section
(b) each of said forms comprising a plurality of elongated panels arranged in edge-to-edge relationship
(c) the edges of said elongated panels having splineways
(d) tie members engaged with opposed panels of said forms and spanning the void therebetween, said tie members being aligned transversely of the forms
(e) each of said tie members including a flat body portion having spaced openings
(f) the ends of said flat body portion having angular tabs for insertion into the splineways of adjacent panels for positioning the latter
(g) a pair of reinforcing rods extending through the openings of said body portion, and extending transversely of the forms
(h) cementitious material in the void between said forms, and
(i) means for fixedly securing form sections at a right angle to each other
(j) said means including lugs cast in place in the form sections adjacent proximate edges thereof
(k) angular connectors extending between, and engaged with, the lugs of the form sections for fixedly securing the sections together
(l) said means further including a corner member inserted between the ends of the form sections and including a body portion
(m) extension members extending outwardly from said body portion into the panel splineways of the form sections for holding the corner member in position.

34. Reinforced masonry construction for walls and slabs including
(a) permanent forms spaced apart a predetermined distance to provide a structural section
(b) each of said forms comprising a plurality of elongated panels arranged in edge-to-edge relationship
(c) the edges of said elongated panels having splineways
(d) tie members engaged with opposed panels of said forms and spanning the void therebetween, said tie members being aligned transversely of the forms
(e) each of said tie members including a flat body portion having spaced openings
(f) the ends of said flat body portion having angular tabs for insertion into the splineways of adjacent panels for positioning the latter
(g) a pair of reinforcing rods extending through the openings of said flat portion, and extending transversely of the forms
(h) cementitious material in the void between said forms, and
(i) means for fixedly securing form sections at a right angle to each other
(j) said means including lugs cast in place in the form sections adjacent proximate edges thereof
(k) angular connectors extending between, and engaged with, the lugs of the form sections for fixedly securing the sections together
(l) said lugs and connectors being located exteriorly of the right angle form section.

* * * * *